US010602281B2

(12) United States Patent
Chen

(10) Patent No.: US 10,602,281 B2
(45) Date of Patent: Mar. 24, 2020

(54) SYSTEM WITH THERMOELECTRIC CONVERSION DEVICE

(71) Applicant: Tymphany Acoustic Technology (Huizhou) Co., Ltd., Huizhou, Guangdong Province (CN)

(72) Inventor: Zhiwen Chen, Huizhou (CN)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/406,517

(22) Filed: May 8, 2019

(65) Prior Publication Data

US 2019/0349690 A1 Nov. 14, 2019

(30) Foreign Application Priority Data

May 10, 2018 (CN) ..... 2018 1 0443116

(51) Int. Cl.

| | |
|---|---|
| ***H04R 9/02*** | (2006.01) |
| ***H04R 23/00*** | (2006.01) |
| ***H04R 1/02*** | (2006.01) |
| ***H04R 9/06*** | (2006.01) |

(52) U.S. Cl.

CPC ..... *H04R 23/002* (2013.01); *H04R 1/028* (2013.01); *H04R 9/027* (2013.01); *H04R 9/06* (2013.01)

(58) Field of Classification Search

CPC . H04R 9/00; H04R 9/02; H04R 9/022; H04R 9/06

See application file for complete search history.

(56) References Cited

U.S. PATENT DOCUMENTS 5,166,982 A * 11/1992 Shintaku ..... H04R 1/30 381/117
2008/0232636 A1* 9/2008 Thurber ..... H04R 9/06 181/148

* cited by examiner

*Primary Examiner* — Kile O Blair
(74) *Attorney, Agent, or Firm* — Muncy, Geissler, Olds & Lowe, PC

(57) ABSTRACT

A speaker system with a thermoelectric conversion device includes a basin frame and a vibration system and a magnetic circuit system that are accommodated in the basin frame. The vibration system includes a diaphragm and a voice coil. The magnetic circuit system includes a T-iron, a magnet and a washer, with a magnetic gap between the washer and the magnet and the T-iron. The voice coil moves up and down in the magnetic gap. A thermoelectric conversion device is connected to the speaker including a thermoelectric power generation module, a boost circuit module, and a load management module. The thermoelectric power generation module is fixedly connected to a back surface of the T-iron for thermoelectric power generation. The boost circuit module boosts and regulates a direct current outputted by the thermoelectric power generation module. The load management module performs a power distribution and load management on the boosted new power.

7 Claims, 5 Drawing Sheets

| power increase test | input power | 20W | | | | | | 25W | | 32W | | unit |
|---|---|---|---|---|---|---|---|---|---|---|---|---|
| | operation hours | 10 | 20 | 30 | 40 | 50 | 60 | 90 | 120 | 150 | 180 | min. |
| conventional speaker | voice coil temperature increase | 73 | 85 | 93 | 99 | 104 | 107 | 128 | 131 | 157 | 161 | ℃ |
| Embodiment 1: speaker system with thermoelectric conversion device | voice coil temperature increase | 73 | 82 | 89 | 92 | 95 | 97 | 112 | 114 | 136 | 138 | ℃ |
| | magnet temperature | 31 | 40 | 50 | 52 | 56 | 57 | 61 | 69 | 76 | 80 | ℃ |
| | heat sink temperature | 23 | 30 | 35 | 38 | 40 | 41 | 42 | 50 | 54 | 58 | ℃ |
| | thermoelectric power generation sheet output | 0.28 | 0.38 | 0.5 | 0.54 | 0.58 | 0.59 | 0.62 | 0.65 | 0.68 | 0.7 | V |
| | boost module output | 0 | 0 | 2.77 | 2.77 | 2.77 | 2.77 | 2.77 | 2.77 | 2.77 | 2.77 | V |
| contrast voice coil temperature difference | | 0 | -3 | -4 | -7 | -9 | -10 | -16 | -17 | -21 | -23 | ℃ |

FIG. 5

SYSTEM WITH THERMOELECTRIC CONVERSION DEVICE

CROSS REFERENCE TO RELATED APPLICATIONS

This application claims priority under 35 U.S.C. § 119 to Chinese Patent Application No. CN 201810443116.0, which was filed on May 10, 2018, and which is herein incorporated by reference.

TECHNICAL FIELD

The present invention relates to the technical field of speaker manufacturing, in particular, to a speaker system with a thermoelectric conversion device.

BACKGROUND

Dynamic speakers are the most widely used speakers in the world. As an electroacoustic transducer, the dynamic speaker produces mechanical energy and a large amount of excess thermal energy while generating acoustic energy. This energy conversion is one-way irreversible.

Among them, 90% of the input electric energy is converted into the Joule heat energy of the voice coil. This heat causes the temperature of the voice coil to rise sharply while heating the entire magnetic circuit system of the speaker (including the washer, magnet and T-iron). If the heat generated by the speaker is not dissipated in time, it will easily cause the neodymium magnet to demagnetize at a high temperature, and the voice coil may be burned at a high temperature, which severely limits the resistance power of the speaker. Sometimes, in order to increase the resistance power of the speaker, it is forced to use a voice coil and a neodymium magnet with a higher temperature resistance level, but this not only causes a sharp rise in the cost of the speaker, but the power boost in this manner is rather limited.

At present, the methods commonly used in the industry to improve the heat dissipation of speakers mainly include (1) using metal skeletons and drum papers; (2) increasing forced convection and opening holes in the parts to allow more air to flow through the surface of the voice coil to remove heat; and (3) blackening the magnetic circuit and voice coil to increase radiation efficiency.

However, among the above three methods, (1) when using a metal skeleton and a drum paper, since the internal damping is small, the sound quality is hard, which has a large influence on the sound output; (2) the efficiency of heat dissipation by forcing convection to the voice coil is limited, especially when the heat source is hidden in the speaker, the convection effect is poor; and (3) although blackening the magnetic circuit and the voice coil is beneficial to the heat radiation between the two, the magnetic circuit will rise to a certain temperature quickly, and finally reach the heat balance, then the heat dissipation may not be continued.

Therefore, it is necessary to optimize the design of the existing speaker system, so that while reducing the overall temperature of the speaker, it is desirable to utilize the excess heat energy generated by the speaker.

SUMMARY

In order to solve the above problems existing in the prior art, the present invention provides a speaker system with a thermoelectric conversion device. The thermoelectric power generation module of the thermoelectric conversion device is attached to the surface of the T-iron. The thermoelectric conversion is achieved by heat conduction through contacting, followed by thermoelectric power generation, boost regulation, and load management. The speaker system supplies new power generated by the power generation to the battery, LED lamp or other electrical elements, which may reduce the temperature of the magnetic circuit system of the speaker and realize energy recycling.

To achieve the above object, the present invention provides the following technical solution:

A speaker system includes a basin frame, and a vibration system and a magnetic circuit system that are accommodated in the basin frame. The vibration system includes a diaphragm and a voice coil fixed on the diaphragm through a top end of its winding portion. The magnetic circuit system includes a T-iron, a magnet and a washer, the washer and the magnet being above the T-iron. A magnetic gap is formed between the washer and the magnet and the T-iron. The voice coil moves up and down in the magnetic gap. The system further includes a thermoelectric conversion device connected to the speaker including a thermoelectric power generation module, a boost circuit module, and a load management module. The thermoelectric power generation module is fixedly connected to a back surface of the T-iron for thermoelectric power generation. The boost circuit module boosts and regulates a direct current outputted by the thermoelectric power generation module. The load management module performs a power distribution and load management on the boosted new power.

In the speaker system, the thermoelectric power generation module may utilize the heat generated by the speaker to realize thermoelectric power generation, and the DC voltage of the power generation output is usually low and unstable. Then, the boost circuit module boosts and regulates the DC power to ensure that the new power generated by the power generation may be available. The load management module then manages and controls this available new power and distributes the new power to the corresponding load (electrical elements). In this way, not only may the overall temperature of the speaker may cooled, but also the excess heat generated by the speaker may be utilized and converted into electrical energy.

As a further description of the technical solution of the present invention, the thermoelectric power generation module includes a thermoelectric power generation sheet, a fixing member, and a heat sink. The thermoelectric power generation sheet has a hot end and a cold end, the cold end being attached to the back surface of the T-iron, the hot end being attached to the heat sink. The fixing member fixes the heat sink and the thermoelectric power generation sheet to the T-iron.

The thermoelectric power generation sheet is composed of two substrates, and there are N-type and P-type semiconductor material elements in between. Its hot end is fixed on the surface of the T-iron of the magnetic circuit system to conduct heat through contact, and its cold end is attached to the heat sink, so as to ensure a certain temperature difference between the hot end and the cold end of the thermoelectric power generating sheet for realizing the thermoelectric power generation. Since the heat of the surface of the T-iron is continuously conducted through the thermoelectric power generation sheet to generate electricity, the temperature of the magnetic circuit system is lowered. At the same time, there is thermal radiation between the voice coil and the magnetic circuit system. When the temperature of the magnetic circuit system is lowered, the temperature of the voice coil may also be effectively reduced, thereby avoiding the risk of thermal damage on the components due to excessive temperature, thereby further increasing the ultimate endurance power of the speaker.

As a further description of the technical solution of the present invention, the heat sink is provided with a plurality of heat sink sheets on a side thereof away from the thermoelectric power generation sheet. The plurality of heat sink sheets disposed on the heat sink may effectively dissipate the cold end of the thermoelectric power generation sheet to ensure that the cold end of the thermoelectric power generation sheet maintains a lower temperature. In this way, there is a certain temperature difference between the cold end and the hot end to ensure the power generation efficiency of the power generation sheet.

As a further description of the technical solution of the present invention, the load management module manages and controls the power distribution of two or more loads.

As a further description of the technical solution of the present invention, the load includes a battery, an LED lamp or other electrical elements for the speaker.

The new power generated by the thermoelectric power generation is preferentially charged to the battery under the deployment of the load management module, so that the capacity of the entire system may be converted into a closed loop, which may increase the battery life. When an external charger is used to charge the battery, the load management module supplies the new power generated by the power generation to the LED lamp or other speaker electrical elements to achieve efficient use of energy.

The present invention further provides a sound box comprising the above speaker system with thermoelectric conversion device, wherein the sound box has a first opening and a second opening respectively on two longer sides, the basin frame extending a fixing bracket from the top, the basin frame being fixed to the first opening by the fixing bracket. The heat sink is fixed to the second opening, and the heat sink extends from the second opening.

The heat sink sheets of the heat sink dissipate heat to the outside air, effectively dissipate heat, maintain the cold end of the thermoelectric power generation sheet to a lower temperature, and ensure the power generation efficiency of the thermoelectric power generation sheet. At the same time, the heat of the surface of the T-iron is continuously conducted to the hot end of the thermoelectric power generation sheet for power generation, and the overall temperature of the speaker is also reduced.

Further, the present invention provides another sound box comprising the above speaker system with thermoelectric conversion device, wherein the sound box has a first opening and a second opening respectively on two longer sides, the basin frame extending a fixing bracket from the top, the basin frame being fixed to the first opening by the fixing bracket. The second opening forms an air duct inwardly, and the air duct is aligned with the heat sink.

When the sound box operates, the air inside and outside the sound box is quickly exchanged through the air duct, which is equivalent to adding forced convection to the surface of the heat sink, so that the heat may be effectively dissipated, the cold end of the power generation sheet is maintained at a lower temperature, thereby ensuring that the thermoelectric power generation sheet has good power generation efficiency.

Based on the above technical solutions, the technical effects obtained by the present invention are:

(1) The speaker system with thermoelectric conversion device provided by the present invention uses the thermoelectric power generation module to perform thermoelectric power generation by using the heat conducted by the magnetic circuit system for performing thermoelectric conversion. The speaker system supplies new power generated resulted from the power generation by the excess heat to the battery, LED lamp or other electrical elements, which may reduce the overall temperature of the speaker system and realize energy recycling.

(2) The speaker system with thermoelectric conversion device of the present invention adopts a thermoelectric power generation module with a small size, and may be made into a power generation device having a volume of less than 1 $cm^3$, which is light in weight, has no mechanical transmission part, has no noise during operation, and has no working medium of liquid and gas, so that the environment may not be polluted.

(3) In speaker system with thermoelectric conversion of the present invention, during thermoelectric power generation, the temperature of the magnetic circuit system and the voice coil may be reduced effectively, so that the demagnetization problem of the neodymium magnets existing at high temperatures may be avoided, and at the same time, the neodymium magnet and the voice coil wire with lower temperature resistance may be selected in the process of preparing the speaker, thereby reducing the production cost.

BRIEF DESCRIPTION OF THE DRAWINGS

FIG. 5 is a graph showing power increase test data of a speaker system with thermoelectric conversion device according to the present invention and a conventional speaker.

DETAILED DESCRIPTION

Figure 1:
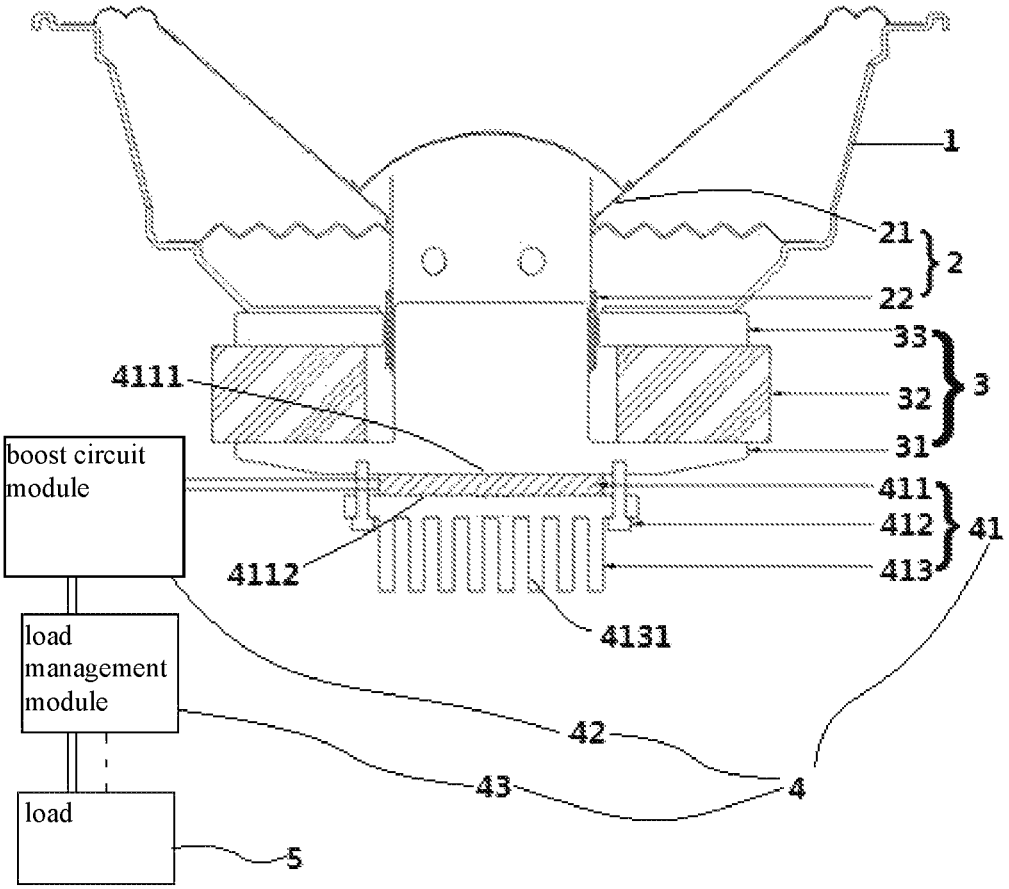
FIG. 1 is a structural view of a speaker system with thermoelectric conversion device according to the present invention.

In order to facilitate the understanding of the present invention, the present invention will be described more fully hereinafter with reference to the accompanying drawings and specific embodiments. Preferred embodiments of the present invention are shown in the drawings. However, the present invention may be embodied in many different forms and is not limited to the embodiments described herein. Rather, these embodiments are provided so that this disclosure of the present invention will be more fully understood.

It should be noted that when an element is referred to as being "fixed" to another element, it can be directly on the other element or a center element can be present. When an element is referred to as being "connected" to another element, it can be directly connected to the other element or a center element can be present simultaneously.

All technical and scientific terms used herein, unless otherwise defined, have the same meaning as commonly understood by one of ordinary skill in the art to the present invention. The terminology used in the description of the present invention is for the purpose of describing particular embodiments and is not intended to limit the present invention.

Embodiment 1

FIG. 1 gives a structural view of a speaker system with thermoelectric conversion device according to the present embodiment. As shown in FIG. 1, a speaker system includes a basin frame 1, and a vibration system 2 and a magnetic circuit system 3 that are accommodated in the basin frame 1, wherein the vibration system 2 includes a diaphragm 21 and a voice coil 22, and the magnetic circuit system 3 includes a T-iron 31, a magnet 32 and a washer 33. As a heat source of the speaker, the voice coil 22 is fixed to the diaphragm 21 by the top end of the winding portion of the diaphragm to vibrate. In the magnetic circuit system 3, the washer 33 and the magnet 32 are located above the T-iron 31, and a magnetic gap is formed between the washer 33 and the magnet 32 and the T-iron 31. The voice coil 22 is configured to move up and down in the magnetic gap. The heat generated when the voice coil is energized causes the temperature of the voice coil 22 to rise. Since the voice coils 22 are close to the magnetic circuit system 3 but are not in contact, the voice coil causes the temperature of the magnetic circuit system to rise by means of thermal radiation. Most of the heat of the magnetic circuit system is exchanged between the T-iron and the outside.

In the speaker system, in order to utilize the excess heat generated by the speaker, a thermoelectric conversion device 4 is provided on the surface of the T-iron. The thermoelectric conversion device 4 is connected to the speaker, and includes a thermoelectric power generation module 41, a boost circuit module 42, and a load management module 43. The thermoelectric power generation module 41 is in direct contact with the T-iron, and is disposed on a back surface of the T-iron, for thermoelectric power generation. The thermoelectric power generation module 41 delivers a DC power generated by the thermoelectric power generation to the boost circuit module 42. Since the DC voltage of the power generation output is generally low and unstable, the booster circuit module 42 boosts and regulates the output DC power of the thermoelectric power generation module 41 to ensure that a new power generated by the power generation may be available. The load management module 43 then manages and controls this available new power and distributes the new power to the corresponding load 5 (electrical elements).

In the speaker system, by adding the thermoelectric conversion device 4, the overall temperature of the speaker is not only effectively reduced, but also the excess heat generated by the speaker is utilized and converted into electrical energy, which is reused in the built-in battery, LED lamp or other elements of the speaker, thereby achieving energy recycling.

Figure 2:
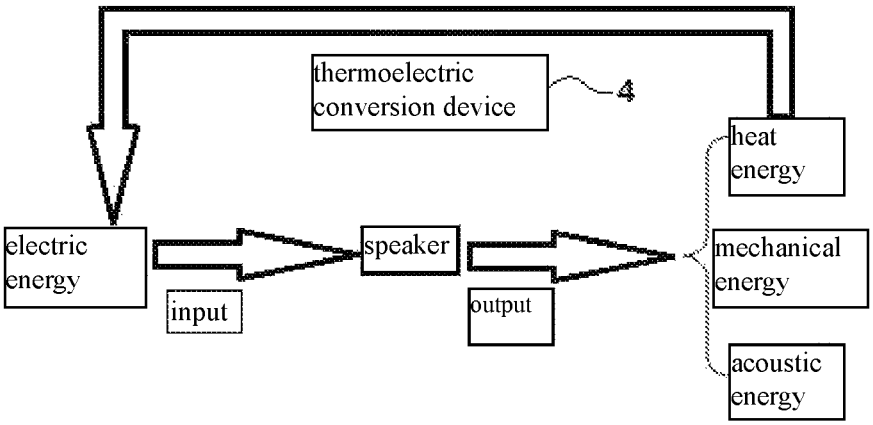
FIG. 2 is a working model view of a speaker system with thermoelectric conversion device according to the present invention.

FIG. 2 is a working model view of a speaker system with thermoelectric conversion device according to the present embodiment. As shown in FIG. 2, the heat generated by the operation of the speaker is utilized by the thermoelectric conversion device 4 to generate new power by thermoelectric power generation.

Figure 3:
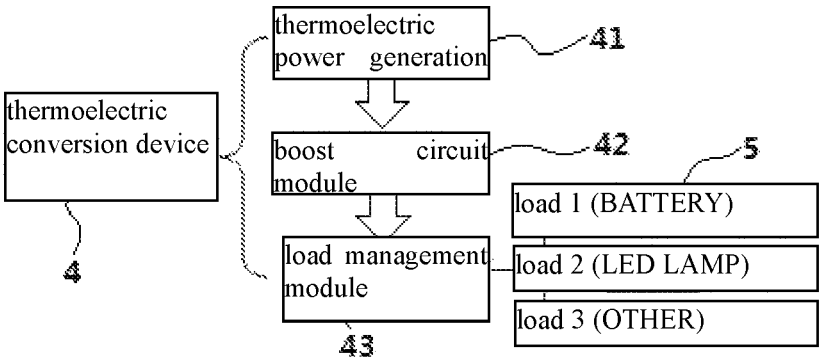
FIG. 3 is a working module view of a thermoelectric conversion device according to the present invention.

FIG. 3 is a working module view of a thermoelectric conversion device according to the present embodiment. As shown in FIG. 3, the load management module 43 manages and controls the power distribution of two or more loads 5, and the load is an electronic element at both ends of the power supply connected in the circuit. In the present embodiment, the load 5 includes a built-in battery, an LED lamp or other electrical elements for the speaker.

The new power generated by the thermoelectric power generation is preferentially charged to the battery (load 1) under the deployment of the load management module 43, so that the capacity of the entire system may be converted into a closed loop, which may increase the battery life. When an external charger is used to charge the battery (load 1), the load management module 43 may disconnect the charging line of the battery (load 1) and switch to supply power to the LED lamp (load 2), that is, may supply the new power generated by the power generation to the LED lamp (load 2) or other speaker electric elements (load 3), to realize efficient use of energy.

Figure 4:
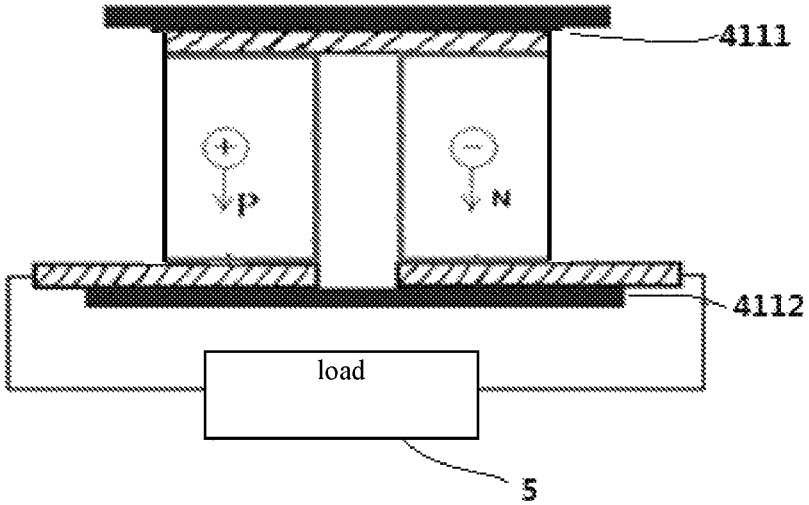
FIG. 4 is a view showing the operation of the thermoelectric power generation sheet according to the present invention.

FIG. 4 is a view showing the operation of the thermoelectric power generation sheet according to the present embodiment. With combined reference to FIGS. 1 and 4, the thermoelectric power generation module 41 includes a thermoelectric power generation sheet 411, a fixing member 412 and a heat sink 413. Among them, the thermoelectric power generation sheet 411 is composed of two substrates, and there are N-type and P-type semiconductor material elements in between. The material of the element is bismuth telluride. The hot end 4111 of the thermoelectric power generation sheet 411 is fixed on the surface of the T-iron 31 of the magnetic circuit system to conduct heat through contact, and its cold end 4112 is attached to the heat sink 413, so as to ensure a certain temperature difference between the hot end 4111 and the cold end 4112 of the thermoelectric power generating sheet for realizing the thermoelectric power generation.

Since the heat of the surface of the T-iron 31 is continuously conducted through the thermoelectric power generation sheet to generate electricity, the temperature of the magnetic circuit system is lowered. At the same time, there is thermal radiation between the voice coil and the magnetic circuit system. When the temperature of the magnetic circuit system is lowered, the temperature of the voice coil may also be effectively reduced, thereby avoiding the risk of thermal damage on the components due to excessive temperature, thereby further increasing the ultimate endurance power of the speaker.

In the present embodiment, a thermoelectric semiconductor is used as the thermoelectric power generation module; the thermoelectric power generation sheet is small in size, and may be made into a power generation device having a volume of less than 1 $cm^3$, which is light in weight and has a weight ranging from several grams to several tens of grams. Moreover, the thermoelectric power generation module has no mechanical transmission part, no noise during operation, no working medium of liquid and gas, and thus may not pollute the environment. Moreover, the thermoelectric power generation module has a fast action speed, a long service life, and is easy to automatically control.

Further, a plurality of heat sink sheets 4131 disposed on a side of the heat sink 413 away from the thermoelectric power generation sheet 411, i.e., on the side where the heat is dissipated to the outside, may effectively dissipate the cold end 4112 of the thermoelectric power generation sheet 411 to ensure that the cold end of the thermoelectric power generation sheet maintains a lower temperature. In this way, there is a certain temperature difference between the cold end 4112 and the hot end 4111 to ensure the power generation efficiency of the power generation sheet.

The fixing member 412 fixes the heat sink 413 and the thermoelectric power generation sheet 411 to the T-iron 31. In the present embodiment, the fixing member 412 is a screw. A tight screw connection between the thermoelectric power generation sheet and the T-iron, and between the thermoelectric power generation sheet and the heat sink, is performed to perform effective thermal contact conduction.

FIG. 5 is a graph showing power increase test data of a speaker system with thermoelectric conversion device according to the present embodiment and a conventional speaker. As shown in FIG. 5, when a power increase test is performed under the same conditions (starting 20W, increasing power per hour), the higher the input power of the speaker, the higher the output voltage of the thermoelectric power generation sheet, and the larger the difference in temperature between the voice coil of a speaker system with thermoelectric conversion device and the voice coil of a conventional speaker, indicating that the speaker system added with a thermoelectric conversion device may achieve thermoelectric conversion, and also reduce the temperature of the voice coil simultaneously.

The speaker system with thermoelectric conversion device of the present embodiment uses the thermoelectric power generation module to perform thermoelectric power generation by using the heat conducted by the magnetic circuit system for performing thermoelectric conversion. The speaker system supplies new power generated resulted from the power generation by the excess heat to the battery, LED lamp or other electrical elements, which may reduce the overall temperature of the speaker system and realize energy recycling.

In addition, in the speaker system, during thermoelectric power generation, the temperature of the magnetic circuit system and the voice coil may be reduced effectively, so that the demagnetization problem of the neodymium magnets existing at high temperatures may be avoided, and the ultimate endurance power of the entire speaker may also be increased; at the same time, the neodymium magnet and the voice coil wire with lower temperature resistance may be selected in the process of preparing the speaker, thereby reducing the production cost.

Embodiment 2

Figure 6:
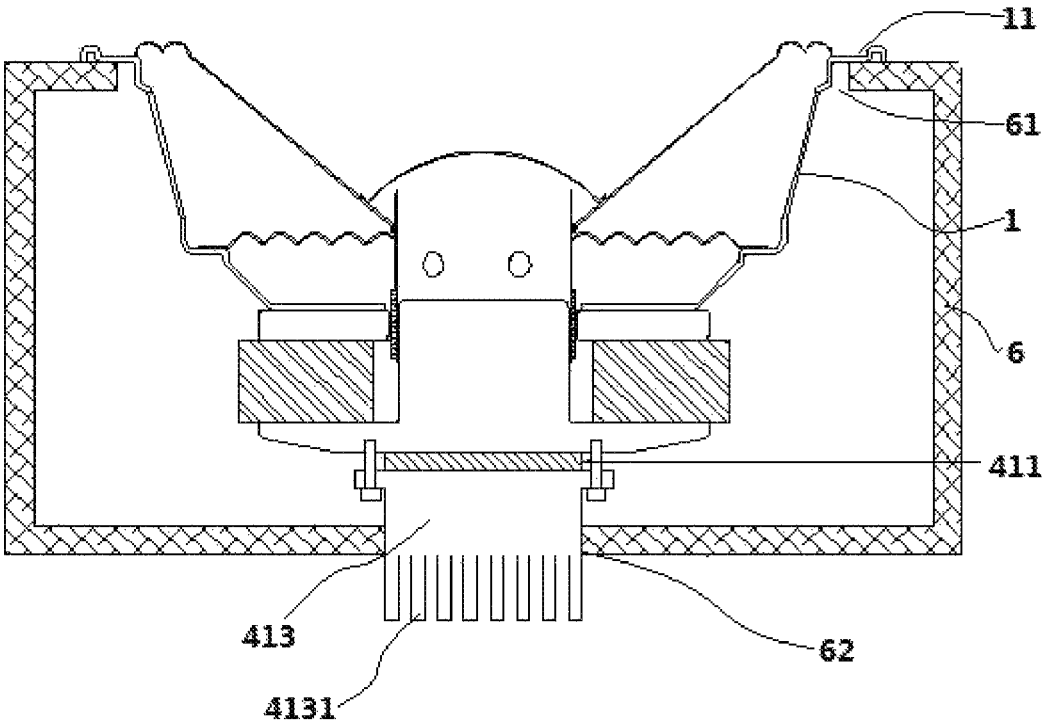
FIG. 6 is a structural view of an embodiment of a sound box comprising the speaker system with thermoelectric conversion device according to the present invention.

FIG. 6 gives a structural view of an embodiment of a sound box comprising the speaker system with thermoelectric conversion device. As shown in FIG. 6, the sound box 6 is a closed sound box, and has a first opening 61 and a second opening 62 respectively on two longer sides of the sound box. Among them, the basin frame 1 has a fixing bracket 11 extending from a top thereof. The basin frame 1 is fixed to the first opening 61 by the fixing bracket 11, the heat sink 413 is fixed to the second opening 62, and the heat sink sheets 4131 of the heat sink 413 extend from the second opening 62.

The heat sink sheets 4131 of the heat sink 413 dissipate heat to the outside air, effectively dissipate heat, maintain the cold end 4112 of the thermoelectric power generation sheet 411 to a lower temperature, and ensure the power generation efficiency of the thermoelectric power generation sheet. At the same time, the heat of the surface of the T-iron is continuously conducted to the hot end of the thermoelectric power generation sheet for power generation, and the overall temperature of the speaker is also reduced.

Embodiment 3

Figure 7:
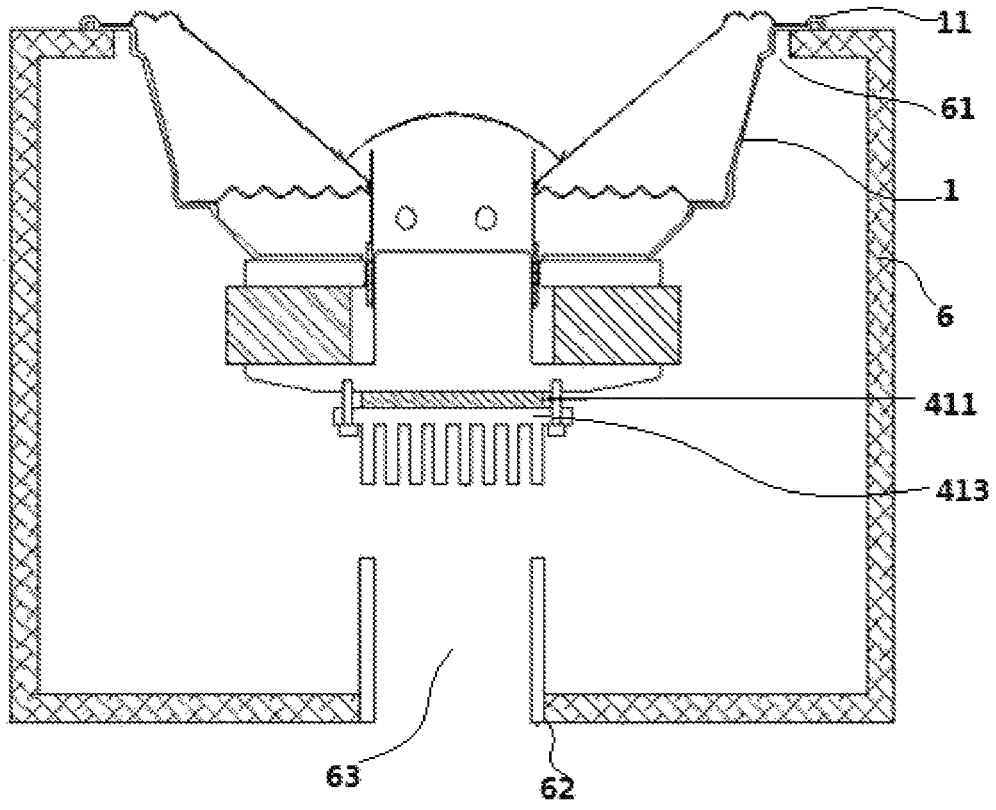
FIG. 7 is a structural view of another embodiment of a sound box comprising the speaker system with thermoelectric conversion device according to the present invention.

FIG. 7 gives a structural view of an embodiment of a sound box comprising the speaker system with thermoelectric conversion device. As shown in FIG. 7, the sound box 6 is an open sound box, and has a first opening 61 and a second opening 62 respectively on two longer sides of the sound box. The basin frame 1 has a fixing bracket 11 extending from the top of the basin frame. The basin frame 1 is fixed to the first opening 61 by the fixing bracket 11. It should be noted that the second opening 62 forms an air duct 63 inwardly, and the air duct 63 is aligned with the heat sink 413.

When the sound box operates, the air inside and outside the sound box is quickly exchanged through the air duct 63, which is equivalent to adding forced convection to the surface of the heat sink 413, so that the heat may be effectively dissipated, the cold end of the power generation sheet is maintained at a lower temperature, thereby ensuring that the thermoelectric power generation sheet has good power generation efficiency.

The above is only an example and description of the structure of the present invention, and the description thereof is more specific and detailed, but is not to be construed as limiting the scope of the present invention. It should be noted that a number of variations and modifications may be made by those skilled in the art without departing from the spirit and scope of the present invention. These obvious alternatives are within the scope of protection of the present invention.

The invention claimed is:

1. A speaker system, comprising
- a basin frame;
- a vibration system accommodated in the basin frame, the vibration system comprising:
  - a diaphragm including a winding portion; and
  - a voice coil fixed on the diaphragm though a top end of the winding portion;
- a magnetic circuit system accommodated in the basin frame; the magnetic circuit system comprising:
  - a T-iron;
  - a magnet located above the T-iron; and
  - a washer located above the T-iron, a magnetic gap disposed between the washer and the T-iron and between the magnet and the T-iron, wherein the voice coil is configured to move up and down in the magnetic gap; and
- a thermoelectric conversion device connected to the speaker, the thermoelectric conversion device comprising:
  - a thermoelectric power generation module fixedly connected to a back surface of the T-iron;
  - a boost circuit module configured to boost and regulate a direct current output by the thermoelectric power generation module; and
  - a load management module configured to perform a power distribution and load management on a boosted power from the boost circuit module.

2. The speaker system according to claim 1, wherein the thermoelectric power generation module comprises:
- a heat sink;
- a thermoelectric power generation sheet comprising:
  - a hot end attached to the heat sink; and a cold end attached to the back surface of the T-iron; and a fixing member configured to fix the heat sink and the thermoelectric power generation sheet to the T-iron.

3. The speaker system according to claim 2, wherein the heat sink comprises a plurality of heat sink sheets on a side thereof away from the thermoelectric power generation sheet.

4. The speaker system according to claim 3, wherein each of the two or more loads includes a battery, an LED lamp or other electrical elements for the speaker.

5. The speaker system according to claim 1, wherein the load management module manages and controls the power distribution of two or more loads.

6. A sound box, comprising:

the speaker system according to claim 1;

a first opening; and a second opening, wherein the basin frame comprises a fixing bracket extending from a top of the basin frame, the basin frame being fixed to the first opening by the fixing bracket, and wherein the heat sink is fixed to and extends from the second opening.

7. A sound box, comprising:

the speaker system according to claim 1;

a first opening; and a second opening, wherein the basin frame comprises a fixing bracket extending from a top of fixing bracket, the basin frame being fixed to the first opening by the fixing bracket, and wherein the second opening forms an air duct inwardly, and the air duct is aligned with the heat sink.

* * * * *